US006821089B2

(12) United States Patent
Bilskie

(10) Patent No.: US 6,821,089 B2
(45) Date of Patent: Nov. 23, 2004

(54) POLE MOUNTED CEILING FAN AND METHOD OF MAKING SAME

(76) Inventor: Larry Bilskie, 237 Morton La., Winter Springs, FL (US) 32708

( * ) Notice: Subject to any disclaimer, the term of this patent is extended or adjusted under 35 U.S.C. 154(b) by 0 days.

(21) Appl. No.: 10/397,918

(22) Filed: Mar. 26, 2003

(65) Prior Publication Data

US 2004/0022636 A1 Feb. 5, 2004

Related U.S. Application Data

(60) Provisional application No. 60/399,623, filed on Jul. 30, 2002.

(51) Int. Cl.[7] ..... F04D 29/64

(52) U.S. Cl. ..... 416/5; 416/146 R; 416/244 R

(58) Field of Search ..... 416/1, 5, 146 R, 416/244 R, 246

(56) References Cited

U.S. PATENT DOCUMENTS

| | | | | |
|---|---|---|---|---|
| 5,336,049 A | | 8/1994 | Herman | |
| 5,765,582 A | | 6/1998 | Molnar, IV | |
| 5,868,152 A | | 2/1999 | Brown | |
| 6,017,188 A | | 1/2000 | Benton | |
| 6,027,309 A | * | 2/2000 | Rawls et al. | 416/5 |
| 6,298,866 B1 | | 10/2001 | Molnar, IV | |
| 6,325,084 B1 | | 12/2001 | Cohen | |
| 6,431,822 B1 | | 8/2002 | Schwing | |
| 2002/0096203 A1 | | 7/2002 | Cohen et al. | |

* cited by examiner

*Primary Examiner*—Christopher Verdier
(74) *Attorney, Agent, or Firm*—William M. Hobby, III

(57) ABSTRACT

A pole mounted ceiling fan includes a conventional electric ceiling fan having a fan housing and an electric motor mounted therein and a plurality of blades coupled to the electric motor for rotation thereby. A center shaft is fixedly attached to the electric fan and extends through the electric motor and plurality of fan blades for attaching a light fixture below the fan housing. A vertically extending pole has a top end and a ceiling fan to pole adapter is attached to the ceiling fan center shaft and to the vertically extending pole so that a conventional ceiling fan is attached to the top of a vertical pole. A method of making a pole mounted ceiling fan includes selecting the conventional ceiling fan and the vertical extending pole and making a ceiling fan to pole adapter for attaching the ceiling fan center shaft to the pole and then attaching the ceiling fan to the pole with the ceiling fan pole adapter.

6 Claims, 2 Drawing Sheets

POLE MOUNTED CEILING FAN AND METHOD OF MAKING SAME

This application claims the benefit of U.S. Provisional Application No. 60/399,623 filed Jul. 30, 2002.

BACKGROUND OF THE INVENTION

The present invention relates to a pole mounted ceiling fan and to a method of making a pole mounted ceiling fan and especially to a pole mounted ceiling fan which attaches a conventional ceiling fan to the top of a vertical pole.

Ceiling fans are fans mounted from the ceiling of a room in a building or from the roof of a covered patio, or the like, and have a housing supported from a pipe or pole attached to the ceiling. They include a motor within the housing coupled to a plurality of rotating fan blades. The fan blades are coupled to the motor such that the fan can have a protruding fixed shaft from which electric wires can be extended through the middle of the electric motor and fan blades. This allows the attaching of switches for the fan below the fan blades and also for the attachment of light fixtures for adding an overhead light in combination with the fan. Ceiling fans provide an energy efficient means of cooling individuals in an area and it becomes desirable to have a ceiling fan with its slow rotation of fan blades in an open area, such as patio decks and screen porches. A pole mounted fan can be used in combination with a deck umbrella and a patio table, if desired. However, conventional ceiling fans are made to be hung from the top from a ceiling and therefore have the mounting for hanging the fan on top of the fan for attaching to a pole extending from the ceiling. To attach a conventional fan to an existing vertical pole would mean turning the fan upside down which would then blow the air in the opposite direction.

The present invention is directed toward utilizing a conventional ceiling fan which is attached directly to the top of a pole facing downward so that it avoids the problem of having a custom made fan and also the other problems involved in custom designing and building a fan for mounting to the top of a pole. To overcome this problem, one prior patent to Schwing, U.S. Pat. No. 6,431,822 has a fan support assembly which includes a column extending vertically from a base. The column has a U-shaped arm on top thereof with a fan adapter plate connected to the end of the arm so that a conventional fan can be attached in a convention manner hanging from the now downwardly extending arm. However, such an arrangement requires a longer vertical reach and requires a considerable mass to support the long U-shaped arm supporting a relatively heavy fan on the end thereof.

Other prior U.S. patents can be seen in the Cohen et al. Publication No. U.S. 2002/0096203 for a Fan Assembly for an Umbrella which takes a conventional umbrella and mounts a fan on the pole beneath the umbrella. In the U.S. Patent to Benton, U.S. Pat. No. 6,017,188, a Patio Table and Pole Fan Combination are illustrated and uses a fan mounted on the pole which passes through the center of the patio table. The fan also has lights mounted thereto and has the umbrella cover mounted on top of the fan. In the Cohen U.S. Pat. No. 6,325,084, a fan is combined with an umbrella and has a fabric or vinyl canopy attached to a plurality of splines. It has a fan assembly mounted to the pole beneath the umbrella with a clamp for attaching the motor housing to the umbrella shaft. In the Herman U.S. Pat. No. 5,336,049, a Salad Bar Fan is illustrated having a pair of fans mounted over a salad bar. The Molnar, IV, U.S. Pat. No. 5,765,582, shows a Table Umbrella Apparatus having the motor mounted in the base of the pole. In the Molnar, IV, U.S. Pat. No. 6,298,866, a Table Umbrella Apparatus has a fan which is directing the air upwards into the table umbrella which then has baffles for directing the air downward onto the table. The Brown U.S. Pat. No. 5,868,152 is a Rotating Patio Umbrella Fan which shows a rotating patio umbrella fan which also has the fan motor mounted in a base for driving a shaft extending through the upwardly extending pole having the fan blades attached above the pole.

In contrast to these prior U.S. patents, the present invention is directed towards making a patio fan or the like using a conventional ceiling fan mounted to the end of a pole but which faces directly down from the pole to direct the air directly down to the area below which may have a patio table or the like thereunder and which simplifies the manufacture and cost of a patio fan.

SUMMARY OF THE INVENTION

A pole mounted ceiling fan includes a conventional electric ceiling fan having a fan housing and an electric motor mounted therein and a plurality of blades coupled to the electric motor for rotation thereby. A center shaft is fixedly attached to the electric fan and extends through the electric motor and plurality of fan blades for attaching a light fixture below the fan housing. A vertically extending pole has a top end and a ceiling fan to pole adapter is attached to the ceiling fan center shaft and to the vertically extending pole so that a conventional ceiling fan is attached to the top of a vertical pole. A method of making a pole mounted ceiling fan includes selecting the conventional ceiling fan and the vertical extending pole and making a ceiling fan to pole adapter for attaching the ceiling fan center shaft to the pole and then attaching the ceiling fan to the pole with the ceiling fan pole adapter.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
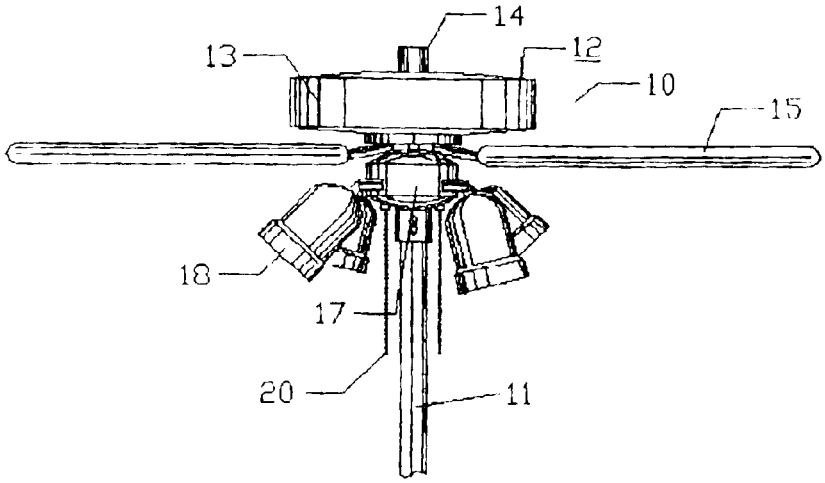
FIG. 1 is a side elevation of a ceiling fan mounted to the top of a vertically extending pole.
Figure 2:
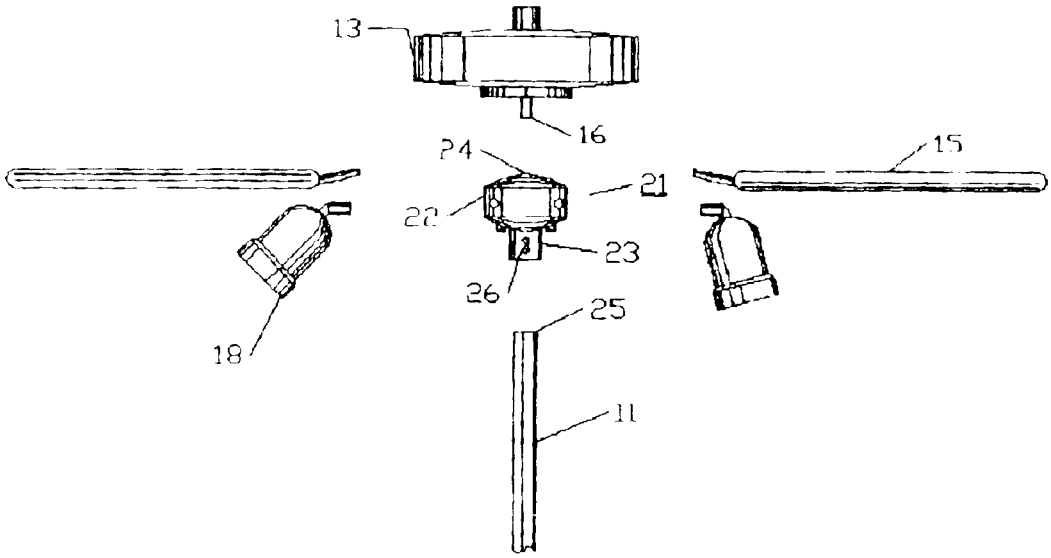
FIG. 2 is an exploded view of the ceiling fan mounted to a pole of FIG. 1.
Figure 3:
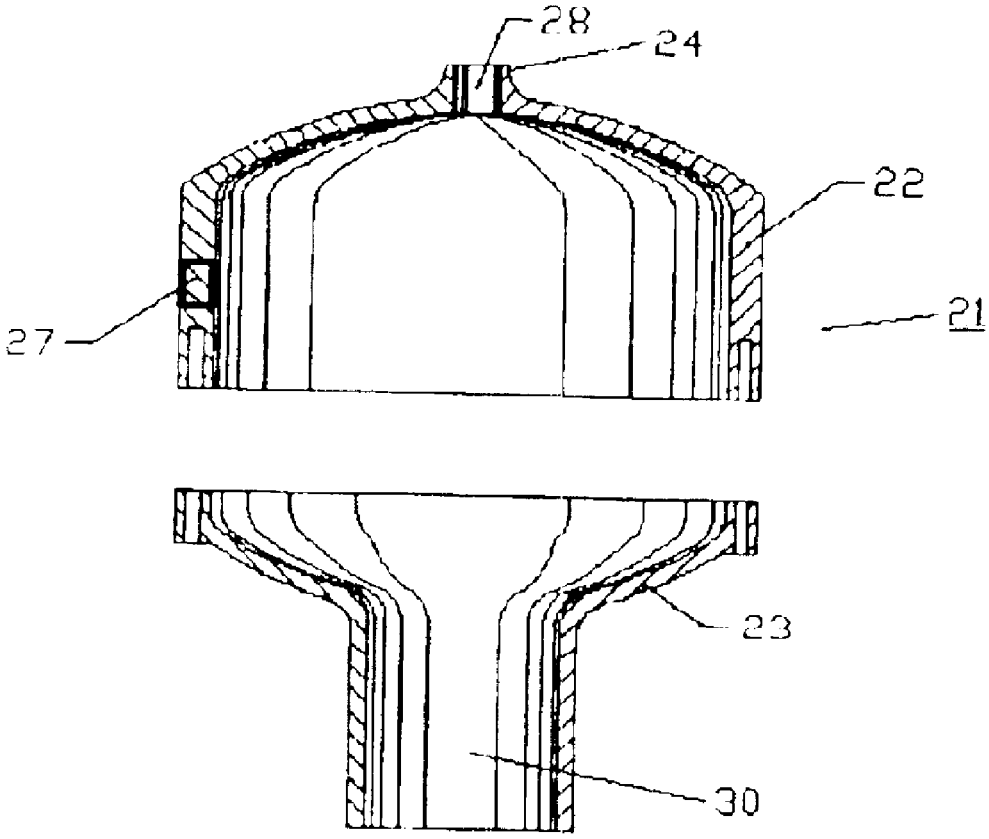
FIG. 3 is an exploded sectional view of a ceiling fan to pole adapter for attaching a ceiling fan to a pole in accordance with FIG. 1.

Referring to the drawings, FIGS. 1–3, a conventional ceiling fan 10 is illustrated mounted to a vertically extending pole 11. The ceiling fan 10 has a motor 12 having a housing 13 therearound and having an upwardly extending shaft 14 designed to attached to a hanging pipe from the ceiling of a room in a building. The fan 10 has a plurality of fan blades 15 attached to the motor so that the blades are rotated by the motor around the center portion of the fan motor to allow a shaft or pipe 16 to extend below the motor housing 13. This non-rotating shaft 16 is provided to pass electrical wires therethrough for attaching a lighting fixture or the like 17 having a plurality of lamps 18 attached thereto and which also allows the fan switch 20 to extend from below the blades 15 of the fan 10. As illustrated, a custom made ceiling fan to pole adapter 21 has a fan attaching portion 22 and a pole attaching portion 23 which fit together, as shown in FIG. 1. The fan attaching adapter portion 22 has an attaching tube 24 which slides over the extending shaft 16 and attaches thereto while the pole attaching portion 23 is adapted to slide over the top 25 of the pole 11 and is anchored with a pair of threaded fasteners 26 or by any other means desired. The fan is sitting atop of the pole 11 but the adapter components 22 and 23 are attached to each other with fasteners and may have the lamps 18 connectors connected into the side thereof through threaded openings 27. That is, the electrical wires will still run through the openings 28 in the shaft portion 24 of the adapter 21 fan attaching portion. The electrical line for connecting to the fan motor passes through the vertically extending shaft or pipe 11 through the passageway 30 in the adapter 21 where it can then connect to the light fixtures 18 and through the switches that are switched from cord 20 to drive the electric motor 12.

A process for making the fan of FIGS. 1–3 is to select an off the shelf ceiling fan 10 having a fan housing having an electric motor mounted therein and a plurality of fan blades coupled to the electric motor for rotation thereby and having a center shaft fixedly attached to the electric fan and extending through the electric motor and plurality of fan blades for attaching a light fixture to the electric fan below the fan housing. A vertically extending pole is then selected having a top end and then making a ceiling fan to pole adapter for attaching to the ceiling fan center shaft into the pole and attaching the selected ceiling fan to the pole with the ceiling fan to pole adapter so that a ceiling fan is attached to the top of a vertical pole facing downward. The method also includes making a ceiling fan to pole adapter which includes a light fixture attached thereto and which can be removably attached to the ceiling fan shaft and to the top of the pole.

I claim:

1. A pole mounted ceiling fan comprising:

a ceiling fan having a fan housing and an electric motor mounted therein and a plurality of fan blades coupled to said electric motor for rotation thereby, and a center shaft fixedly attached to said ceiling fan and extending through said electric motor and plurality of fan blades for attaching a light fixture to said ceiling fan below said fan housing;

a vertically extending pole having a top end; and a ceiling fan to pole adapter attached to said electric fan center shaft, said adapter being attached to said center shaft and removably attached to said pole, said ceiling fan to pole adapter having a fan center shaft attachment portion and a role attachment portion and said center shaft attachment portion and said pole attachment portion being removably attached to each other; whereby the ceiling fan is attached to the top of the vertical pole.

2. The pole mounted ceiling fan in accordance with claim 1 in which said ceiling fan to pole adapter has at least one light fixture attached thereto.

3. The pole mounted ceiling fan in accordance with claim 1 in which said ceiling fan to pole adapter is removably attached to said ceiling fan center shaft.

4. A method of making a pole mounted ceiling fan comprising:

selecting a ceiling fan having a fan housing and an electric motor mounted therein and a plurality of fan blades coupled to said electric motor for rotation thereby, and a center shaft fixedly attached to said electric fan and extending through said electric motor and plurality of fan blades for attaching a light fixture to said ceiling fan below said fan housing;

selecting a vertically extending pole having a top end;

making a ceiling fan to pole adapter for attaching to said ceiling fan center shaft and to said pole including making the adapter having a fan center shaft attachment portion and a pole attachment portion and said center shaft attachment portion and said role attachment portion being removably attached to each other; and attaching said selected ceiling fan to said pole with said ceiling fan to pole adapter;

whereby the ceiling fan is attached to the top of the vertical pole.

5. The method of making a pole mounted ceiling fan in accordance with claim 4 in which the step of making a ceiling fan to pole adapter includes making the adapter having a light fixture attached thereto.

6. The method of making a pole mounted ceiling fan in accordance with claim 4 in which the step of making a ceiling fan to pole adapter includes making the ceiling fan to pole adapter removably attached to said ceiling fan center shaft and removably attached to said pole.

* * * * *